US005399467A

United States Patent [19]

Krishnamurthy et al.

[11] Patent Number: 5,399,467

[45] Date of Patent: Mar. 21, 1995

[54] PHOTOGRAPHIC COUPLERS HAVING A BALLAST CONTAINING A SULFONE OR SULFOXIDE GROUP

[75] Inventors: Sundaram Krishnamurthy; Stanley W. Cowan, both of Rochester, N.Y.

[73] Assignee: Eastman Kodak Company, Rochester, N.Y.

[21] Appl. No.: 144,754

[22] Filed: Oct. 29, 1993

[51] Int. Cl.[6] ..... G03C 7/34; G03C 7/384

[52] U.S. Cl. ..... 430/384; 430/385; 430/386; 430/387; 430/552; 430/553; 430/554; 430/555

[58] Field of Search ..... 430/386, 387, 554, 555, 430/384, 385, 552, 553, 556, 557, 388, 389

[56] References Cited

U.S. PATENT DOCUMENTS 3,615,506 10/1971 Abbott et al. ..... 430/554
4,286,053 8/1981 Ishikawa et al. ..... 430/389

FOREIGN PATENT DOCUMENTS 539563 4/1957 Canada ..... 430/544
0349331 1/1990 European Pat. Off. .
0111644 6/1984 Japan ..... 430/553
3080244 4/1991 Japan ..... 430/553

*Primary Examiner*—Lee C. Wright
*Attorney, Agent, or Firm*—Arthur E. Kluegel

[57] ABSTRACT

Novel photographic silver halide materials contain dye-forming couplers represented by formula (I):

(I)

wherein K is a coupler moiety based on pyrazolone, phenol, naphthol, enamine, or acylacetamide to which the ballast group is attached, are useful in photographic materials and processes. The containing the couplers exhibit increased coupling activity, and provide formation of dyes having improved maximum magenta image dye density, contrast, and development speed.

10 Claims, No Drawings

PHOTOGRAPHIC COUPLERS HAVING A BALLAST CONTAINING A SULFONE OR SULFOXIDE GROUP

This invention relates to novel photographic silver halide materials containing certain dye-forming photographic couplers, to processes using such materials, and to the couplers themselves and the dyes formed thereby.

Color images are customarily obtained in the photographic art by reaction between an oxidation product of a silver halide developing agent and a dye-forming coupler. The dyes formed from the couplers generally have a main absorption in the red, green or blue regions of the visible spectrum. Couplers which form cyan, magenta, and yellow dyes dyes upon reaction with oxidized color developing agents are well known. Such couplers typically include a ballast group attached to the coupler nucleus. Generally, a ballast group is an organic radical of such size and configuration as to confer on the coupler molecule sufficient bulk to render the coupler substantially non-diffusible from the layer in which it is coated in a photographic element.

While such dye-forming couplers are useful in photographic silver halide materials and processes, many of such couplers do not have sufficient coupler reactivity.

The present invention provides novel couplers exhibiting increased coupler reactivity, improved contrast and improved development speed. Additionally, the couplers provide maximum dye density, and exhibit satisfactory solubility, dispersability and bathochromic hue.

The couplers according to the present invention are represented by formula (I):

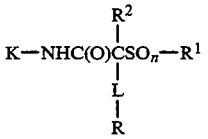

(I)

wherein:

n is 1 or 2;

$R^2$ represents hydrogen or a substituent;

R and $R^1$ independently represent a substituent;

L is selected from the group consisting of O, S, Se, Te, $Si(R^5)_2$, $NR^5$, $PR^5$, $P(O)(R^5)_2$ and $NR^5SO_2$, wherein $R^5$ represents hydrogen, alkyl or aryl; and K is a coupler moiety based on pyrazolone, phenol, naphthol, enamine, or acylacetamide to which the ballast group is attached.

Preferred couplers are represented by formula (II):

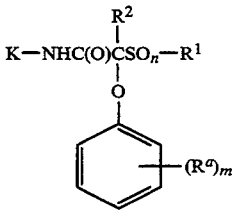

(II)

wherein:

n, $R^2$, $R^1$ and K are as previously defined;

m is from 0 to 5; and each $R^a$ is independently a substituent.

An embodiment of the invention is a photographic element comprising a support bearing at least one photographic silver halide emulsion layer and a dye-forming coupler of formula (I) or (II).

While not wishing to be bound by theory, it is believed that the ballast group, containing a combination of the sulfone or sulfoxide group and the L linkage attaching the substituent R group to the tertiary carbon atom, contributes to the desired improved properties of the couplers. Particularly advantageous results are obtained when the ballast group contains the aryloxy group as in formula (II).

In the above formulae, K represents a coupler moiety often referred to as a coupler parent or coupler nucleus. K includes coupler moieties employed in conventional color-forming photographic processes which yield colored products based on reactions of couplers with oxidized color developing agents. The couplers can be moieties which yield colorless products on reaction with oxidized color developing agents. The couplers can also form dyes which are unstable and which decompose into colorless products. Further, the couplers can provide dyes which wash out of the photographic recording materials during processing. Such coupler moieties are well known to those skilled in the art.

Many K moieties are known. The dyes formed therefrom generally have their main absorption in the red, green, or blue regions of the visible spectrum. For example, couplers which form cyan dyes upon reaction with oxidized color developing agents are described in such representative patents and publications as: U.S. Pat. Nos. 2,772,162; 2,895,826; 3,002,836; 3,034,892; 2,474,293; 2,423,730; 2,367,531; 3,041,236; 4,333,999; and "Farbkuppler: Eine Literaturübersicht," published in Agfa Mitteilungen, Band III, pp. 156–175 (1961).

Suitably such couplers are phenols or naphthols which form cyan dyes on reaction with oxidized color developing agent at the coupling position, i.e. the carbon atom in the 4-position of the phenol or naphthol. Structures of such preferred cyan coupler moieties are:

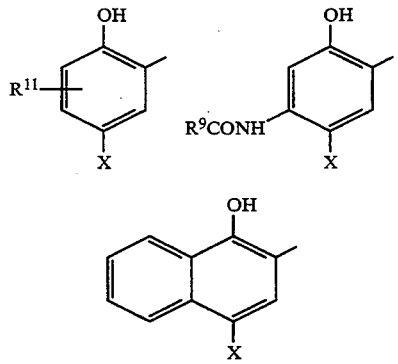

where $R^9$ can represent a ballast group oR a substituted or unsubstituted alkyl or aryl group, X represents a coupling-off group, and $R^{11}$ represents one or more halogen (e.g. chloro, fluoro), alkyl having from 1 to 4 carbon atoms or alkoxy having from 1 to 4 carbon atoms.

Couplers which form magenta dyes upon reaction with oxidized color developing agent are described in such representative patents and publications as: U.S. Pat. Nos. 2,600,788; 2,369,489; 2,343,703; 2,311,082;

3,824,250; 3,615,502; 4,076,533; 3,152,896; 3,519,429; 3,062,653; 2,908,573; 4,540,654; and "Farbkuppler: Eine Literaturübersicht," published in Agfa Mitteilungen, Band III, pp. 126–156 (1961).

Preferably such couplers are pyrazolones which form magenta dyes upon reaction with oxidized color developing agents at the coupling position, i.e. the carbon atom in the 4-position. Structures of such preferred magenta coupler moieties are:

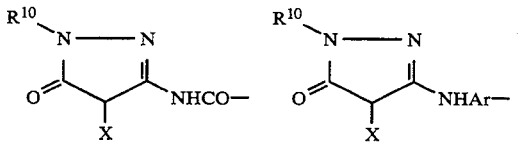

where $R^{10}$ is as defined above and Ar is an aromatic group; $R^{10}$ for pyrazolone structures is typically phenyl or substituted phenyl, such as for example 2,4,6-trihalophenyl.

Couplers which form yellow dyes upon reaction with oxidized color developing agent are described in such representative patents and publications as: U.S. Pat. Nos. 2,875,057; 2,407,210; 3,265,506; 2,298,443; 3,048,194; 3,447,928; and "Farbkuppler: Eine Literaturü bersicht," published in Agfa Mitteilungen, Band III, pp. 112–126 (1961).

Preferably such yellow dye-forming couplers are acylacetamides, such as benzoylacetanilides and pivalylacetanilides. The couplers react with oxidized developer at the coupling position, i.e. the active methylene carbon atom.

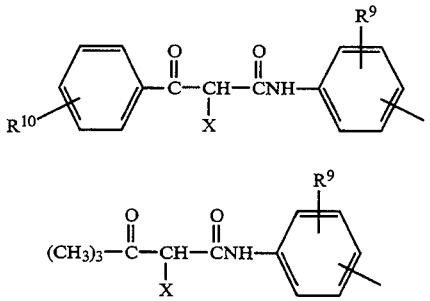

where $R^9$ and $R^{10}$ are as defined above for $R^9$ and can also be hydrogen, alkoxy, alkoxycarbonyl, alkanesulfonyl, arenesulfonyl, aryloxycarbonyl, carbonamido, carbamoyl, sulfonamido, or sulfamoyl, $R^{11}$ is hydrogen or one or more halogen, lower alkyl (e.g. methyl, ethyl), lower alkoxy (e.g., methoxy, ethoxy), or a ballast (e.g. alkoxy of 16 to 20 carbon atoms) group.

Couplers which form colorless products upon reaction with oxidized color developing agent are described in such representative patents as: U.K. Pat. No. 861,138 and U.S. Pat. Nos. 3,362,345, 3,928,041, 3,958,993 and 3,961,959. Preferably, such couplers are cyclic carbonyl containing compounds which form colorless products on reaction with oxidized color developing agent and have the L group attached to the carbon atom in the α-position with respect to the carbonyl group.

Structures of such preferred coupler moieties are:

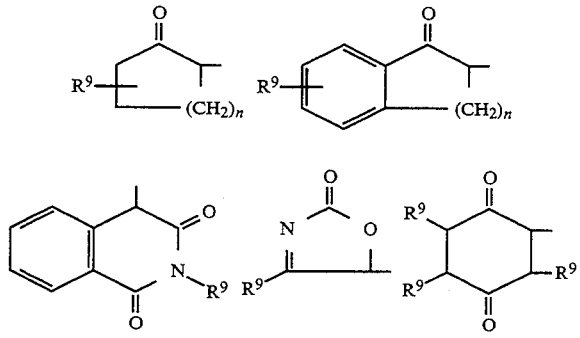

where $R^9$ is as defined above, and n is 1 or 2.

Also suitable are "universal" or "washout" couplers such as those described in U.S. Pat. Nos. 5,026,628; 5,151,343; and 5,234,800.

Preferred K-Groups are represented below:

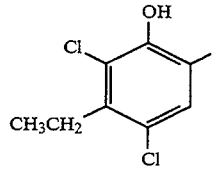

(K-1)

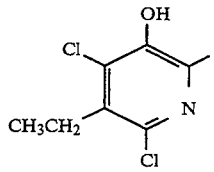

(K-2)

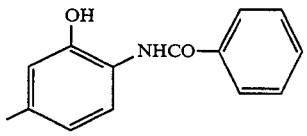

(K-3)

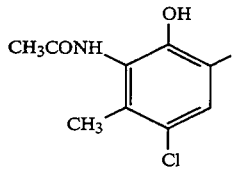

(K-4)

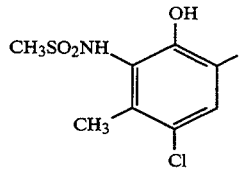

(K-5)

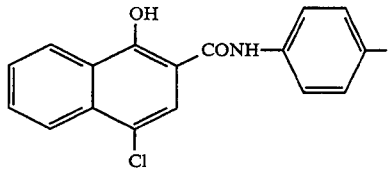

(K-6)

-continued
(K-7)
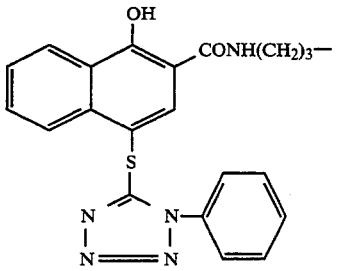
(K-8)
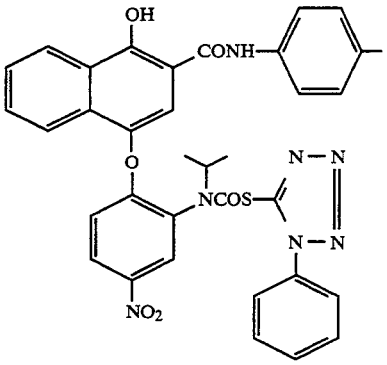
(K-9)
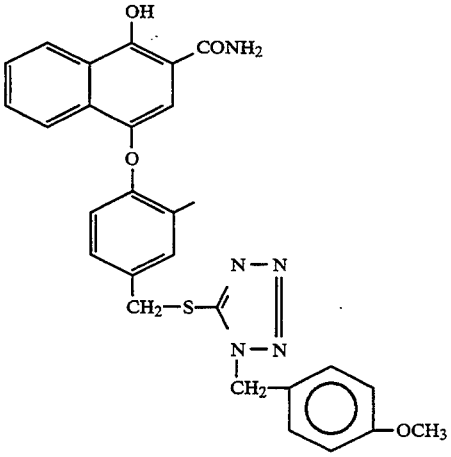
(K-10)
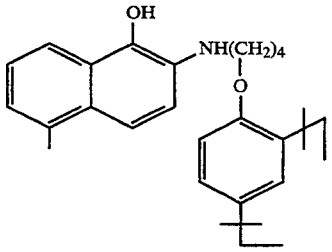
-continued
(K-11)
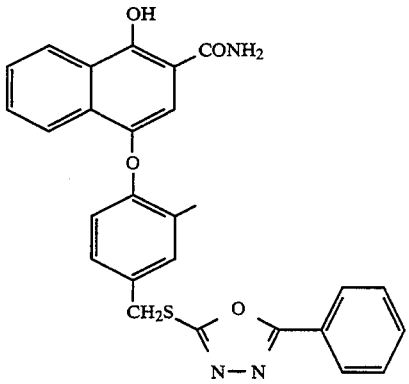
(K-12)
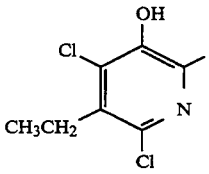
(K-13)
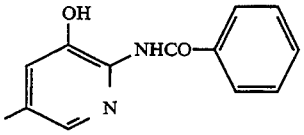
(K-14)
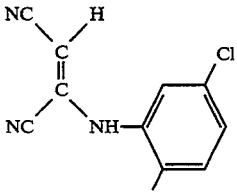
(K-15)
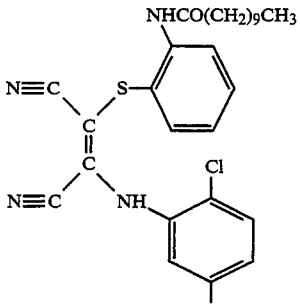
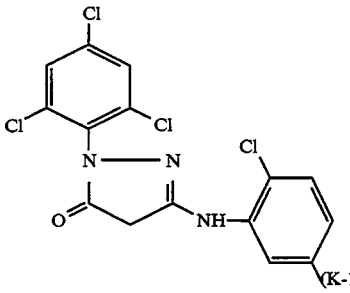
(K-16)

-continued
(K-17)
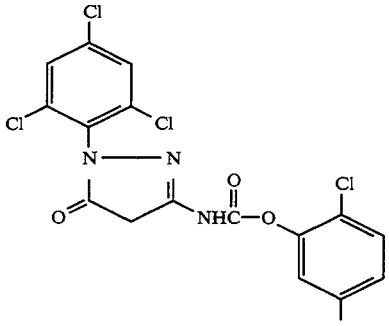
(K-18)
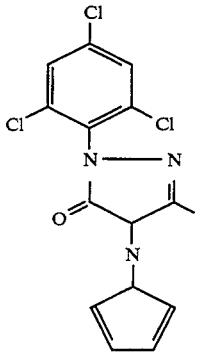
(K-19)
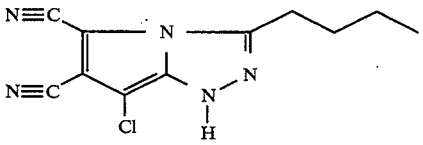
(K-20)
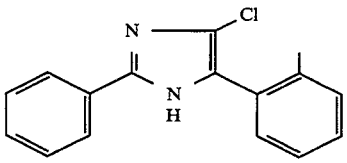
(K-21)
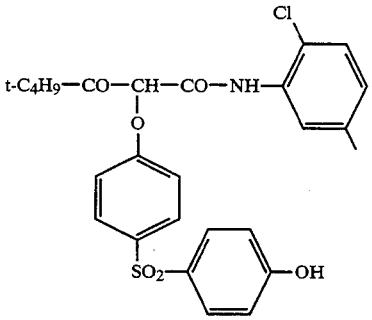
-continued
(K-22)
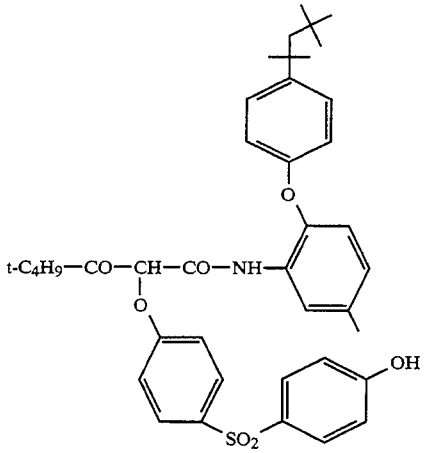
(K-23)
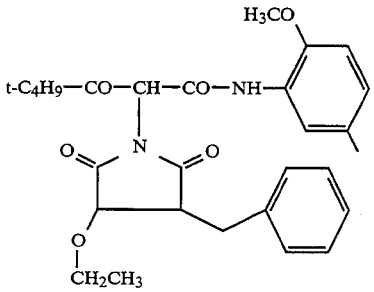
(K-24)
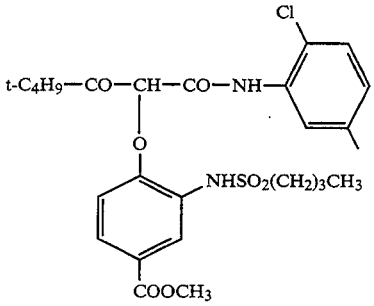
(K-25)
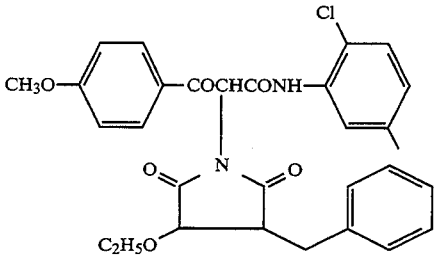
(K-26)
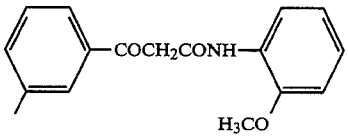

-continued
(K-27)
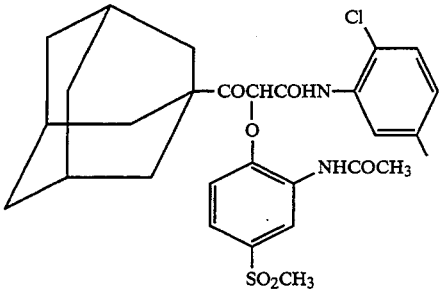
(K-28)
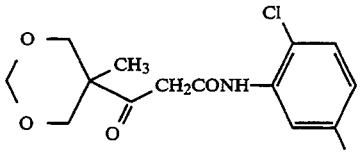
Some particularly preferred K groups are shown below.
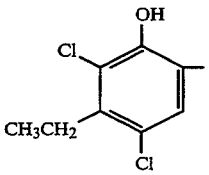
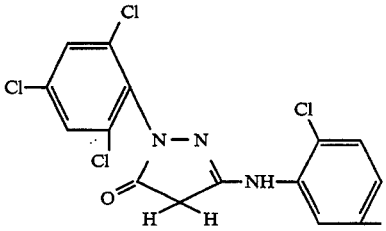
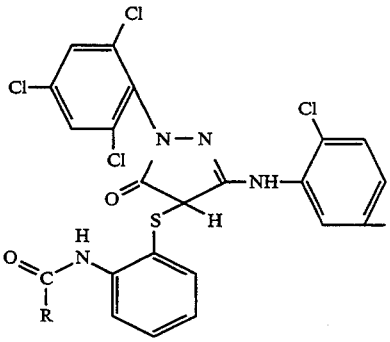
R=unsubstituted or substituted alkyl, unsubstituted or substituted aryl.
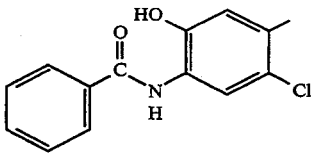
-continued
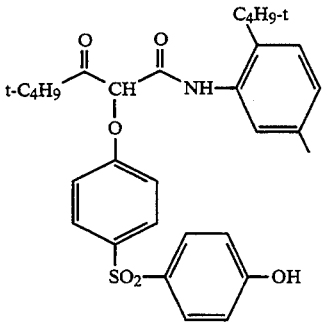
Some preferred ballast groups are represented below:
(B-1)
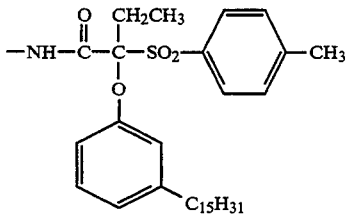
(B-2)
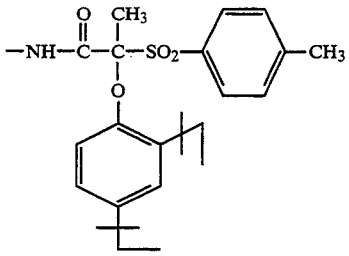
(B-3)
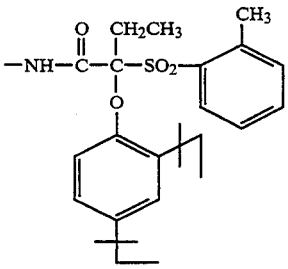
(B-4)
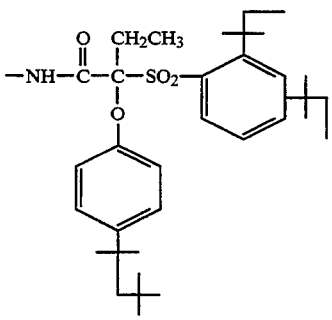

-continued
(B-5)
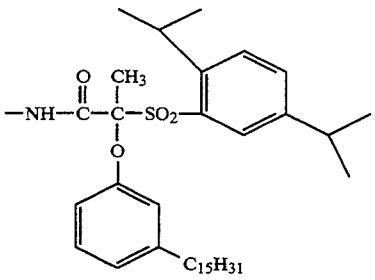
(B-6)
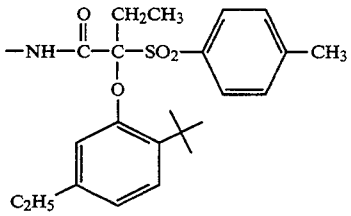
-continued
(B-7)
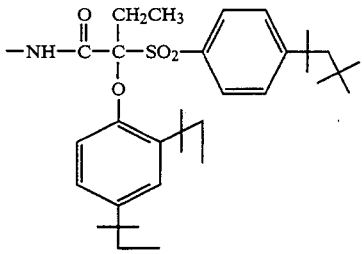
(B-8)
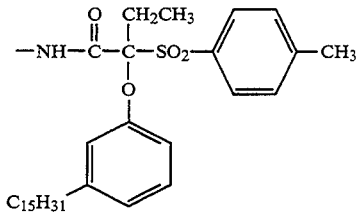
Illustrative examples of useful couplers as described are as follows:
M-1
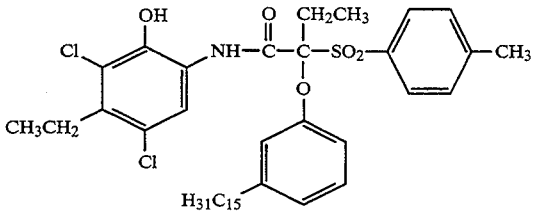
M-2
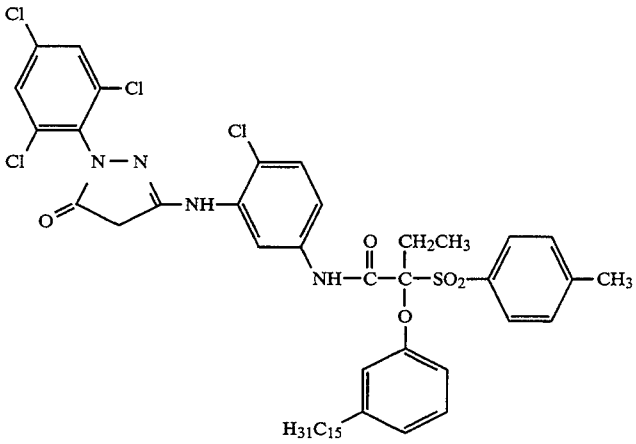

-continued
M-3
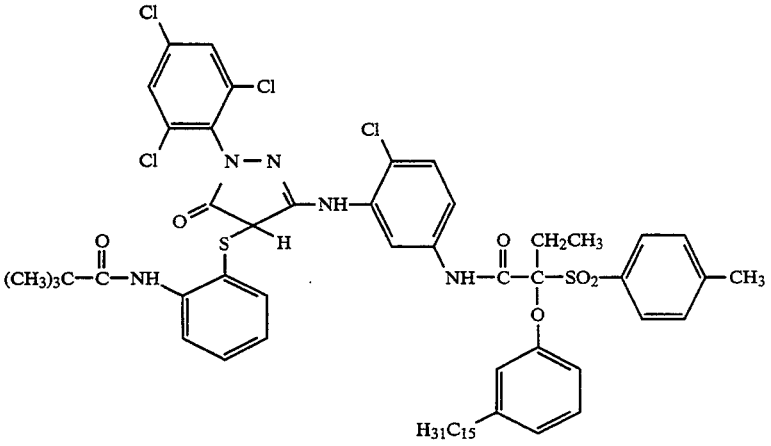
M-4
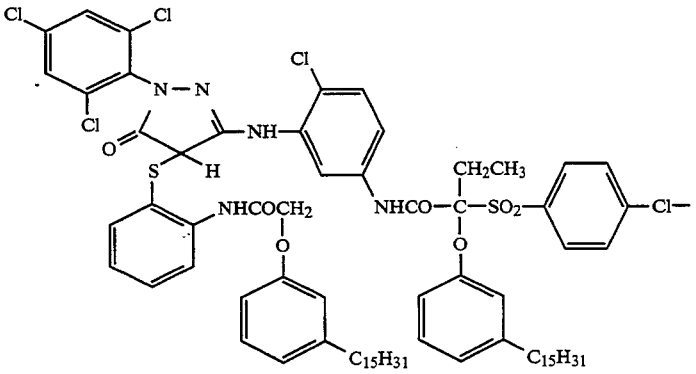
M-5
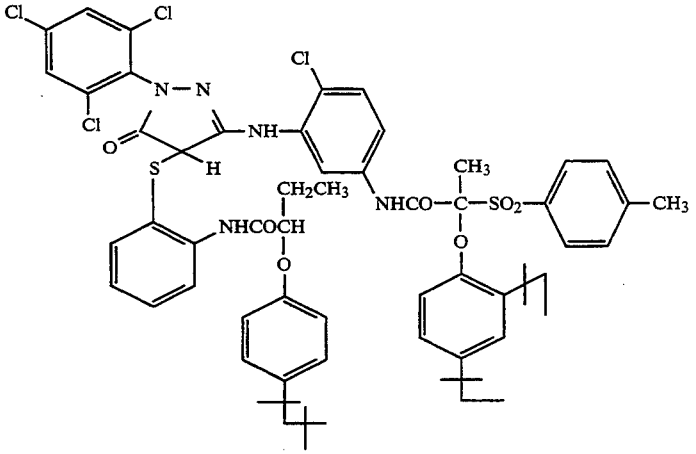

-continued
M-6
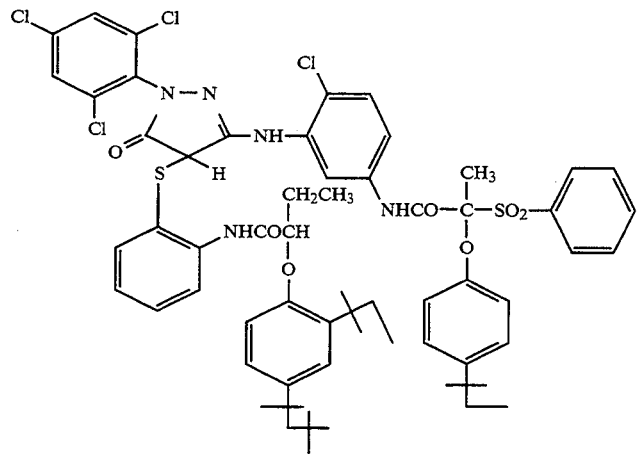
M-7
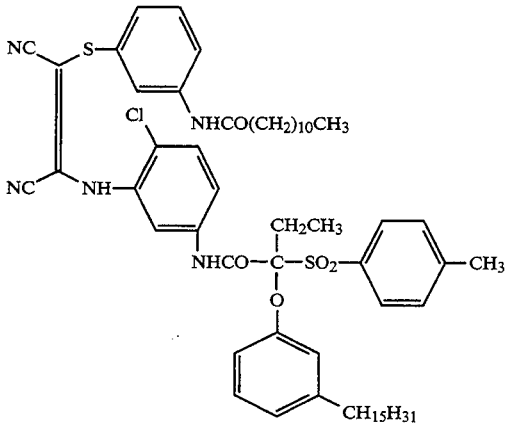
M-8
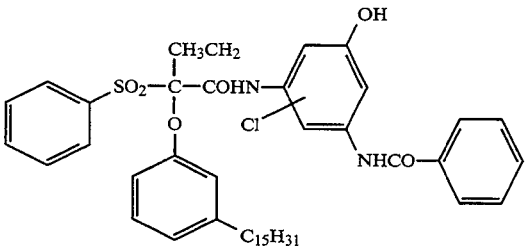
M-9
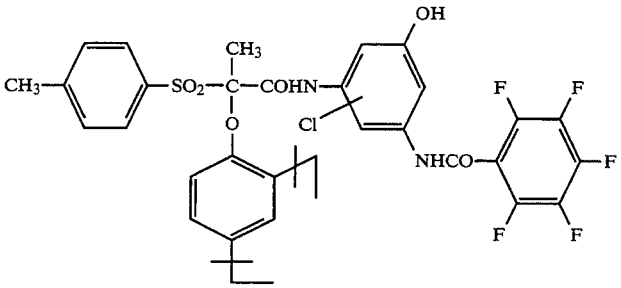

-continued

M-10

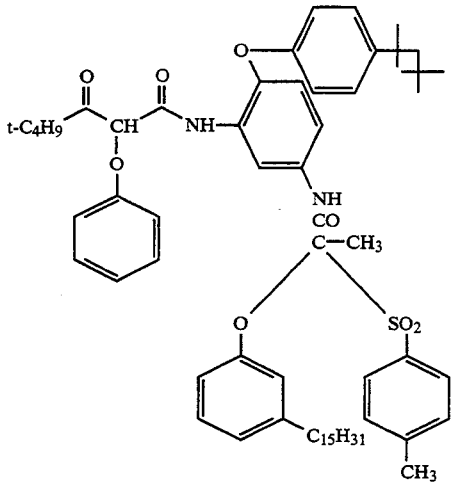

M-11

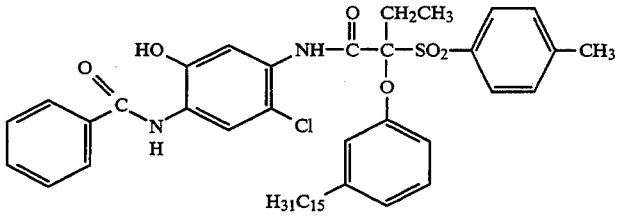

In the above formulae (I) and (II), n represents 1 or 2. In a preferred embodiment, n is 2.

$R^2$ represents hydrogen or a substituent. In more detail, $R^2$ represents hydrogen, halogen or an aliphatic residue including a straight or branched alkyl or alkenyl or alkynyl group having 1 to 32 carbon atoms, a heterocycle, an aralkyl group, a cycloalkyl group or a cycloalkenyl group. The aliphatic residue may be substituted with a substituent bonded through an oxygen atom, a nitrogen atom, a sulfur atom or a carbonyl group, a hydroxy group, an amino group, a nitro group, a carboxy group, an amido group, cyano or halogen.

R and $R^1$, which may the same or different, each represents a substituent as defined for $R^2$. In a preferred embodiment, $R^1$ represents an alkyl, a substituted alkyl, an aryl or a substituted aryl group.

In an especially preferred embodiment, R and L together represent an aryloxy group, as shown in formula (II). $R^a$ and $R^b$, which may the same or different, may be hydrogen or a substituent as defined for $R^2$.

In formulae (I) and (II), the moiety attached to the K coupler represents a ballast group. Generally, a ballast group is an organic radical of such size and configuration as to confer on the coupler molecule sufficient bulk to render the coupler substantially non-diffusible from the layer in which it is coated in a photographic element. Thus, the combination of groups $R^2$, $R^1$, R and L, as well as $R^a$ and $R^b$ in formula (II), are chosen to meet this criteria as can be determined by one skilled in the art.

The K coupler moieties contain in the coupling position, represented by $X^3$ through $X^5$, hydrogen or a coupling-off group also known as a leaving group.

Coupling-off groups are known to those skilled in the art. Such groups can determine the equivalency of the coupler, can modify the reactivity of the coupler, or can advantageously affect the layer in which the coupler is coated or other layers in the element by performing, after release from the coupler, such functions as development inhibition, development acceleration, bleach inhibition, bleach acceleration, color correction, and the like. Representative classes of coupling-off groups include halogen, particularly chlorine, bromine, or fluorine, alkoxy, aryloxy, heterocyclyloxy, heterocyclic, such as hydantoin and pyrazolo groups, sulfonyloxy, acyloxy, carbonamido, imido, acyl, heterocyclylimido, thiocyano, alkylthio, arylthio, heterocyclylthio, sulfonamido, phosphonyloxy and arylazo.

Examples of specific coupling-off groups are

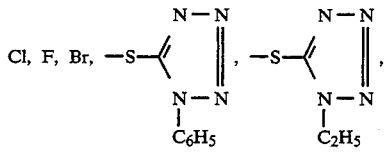

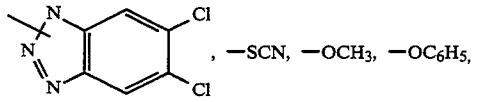

$-OCH_2CONHCH_2CH_2OH$, $-OCH_2CONHCH_2CH_2OCH_3$, $-OCH_2CONHCH_2CH_2OCOCH_3$, $-NHSO_2CH_3$,

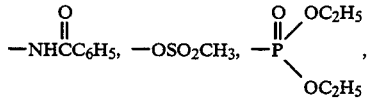

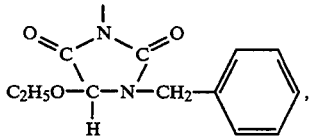

-continued

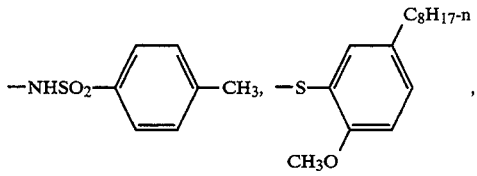

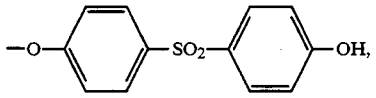

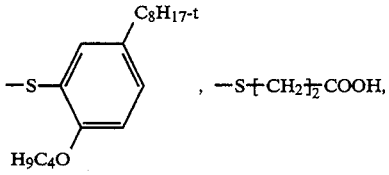

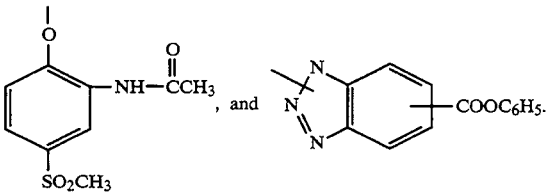

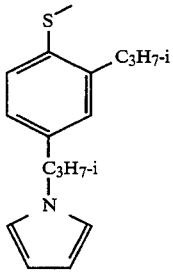

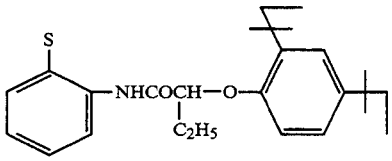

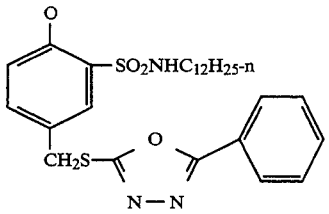

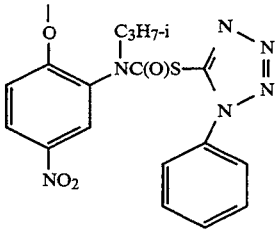

$R^{10}$ represents a ballast group or a substituted or unsubstituted alkyl or aryl group known in the photographic art. A ballast group as described is an organic radical of such size and configuration as to confer on the coupler molecule sufficient bulk to render the coupler substantially non-diffusible from the layer in which it is coated in a photographic element. Couplers of the invention may be attached to ballast groups, or to polymeric chains through one or more of the groups on the coupler nucleus. For example, one or more coupler moieties can be attached to the same ballast group. Representative ballast groups include substituted or unsubstituted alkyl or aryl groups containing 8 to 32 carbon atoms. Representative substituents include alkyl, aryl, alkoxy, aryloxy, alkylthio, arylthio, hydroxy, halogen, alkoxycarbonyl, aryloxycarbonyl, carboxy, acyl, acyloxy, carbonamido, carbamoyl, alkylsulfonyl, arylsulfonyl, sulfonamido, and sulfamoyl groups wherein the alkyl and aryl substituents and the alkyl and aryl portions of the alkoxy, aryloxy, alkylthio, arylthio, alkoxycarbonyl, arylcarbonyl, acyl, acyloxy, carbonamido, carbamoyl, alkylsulfonyl, arylsulfonyl, sulfonamido, and sulfamoyl substituents containing 1 to 30 carbon atoms and 6 to 30 carbon atoms, respectively, can be further substituted with such substituents.

The couplers as described can be used in ways and for purposes that couplers have been used in the photographic art.

The couplers as described can be prepared by general methods of synthesis described in the art. However, the following synthesis Scheme I, wherein acid (1) is directly sulfonated to provide ballast acid (2), is preferred and provides good results. The obtained ballast acid (2) is converted to its acid chloride, which is then reacted with a coupler-amine. Acid (1) and the coupler-amine are available in the art.

An illustrative synthesis of a coupler as described is as follows. Although this scheme illustrates the preparation of couplers of formula (II), it is understood that couplers of formula (I) can be produced by following this reaction scheme.

Scheme I - Preparation of Ballast Acid (2)

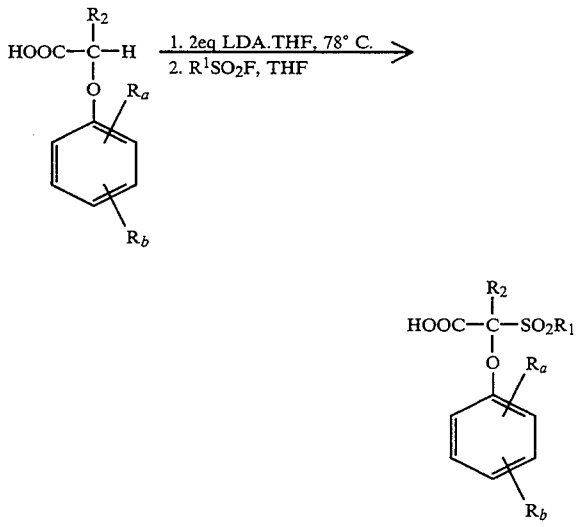

Scheme II - Preparation of Coupler from coupler-amine

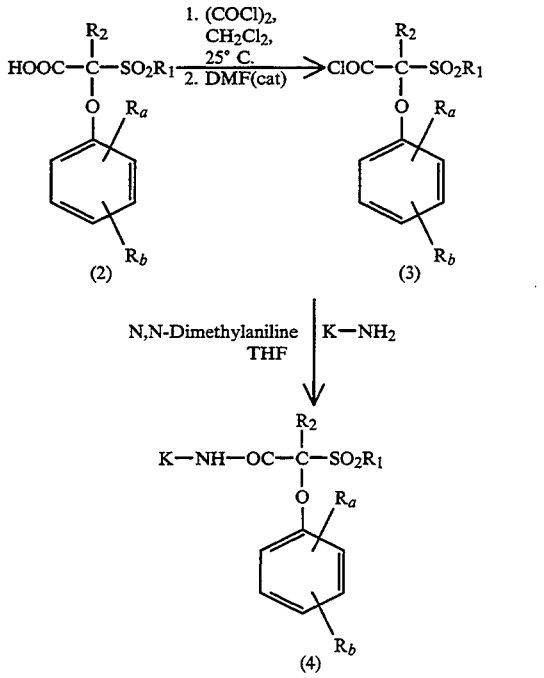

Preparation of ballast acid (2)

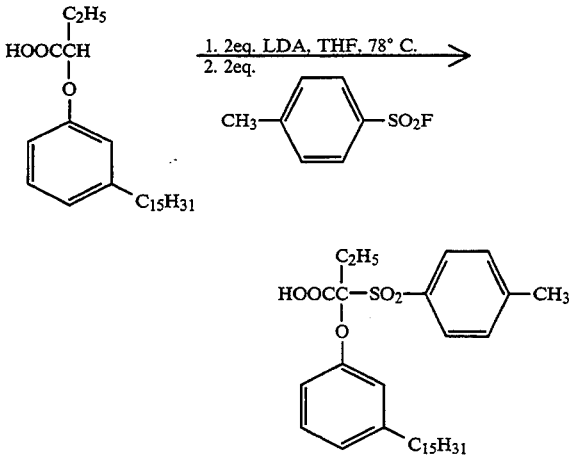

To a magnetically stirred 2-L,3-neck flask, fitted with two graduated addition funnels, heat dried and cooled under a stream of argon was added freshly distilled diisopropylamine (40.9 g, 404 mmol) and tetrahydrofuran (185 mL) dried over molecular sieves. The solution was treated with n-butyllithium (2.5M in n-hexane, 161 mL, 404 mmol) at −20° C. (ice-acetone bath), added dropwise over a period of 45 min. The resulting mixture was allowed to equilibrate to 0° C. After 45 minutes at 0° C., the solution was cooled to −78° C., and a solution of the ballast acid 1, (MW 390.61, 71.7 g, 184 mmol) dissolved in THF (185 mL) was added. After 30 minutes at −78° C., the mixture was stirred at 0° C. for an additional period of 30 minutes. The mixture was cooled to −78° C. again and a solution of p-toluenesulfonyl fluoride (67.2 g, 386 mmol) in THF (100 mL) was added. The well stirred mixture was allowed to warm to room temperature overnight. The reaction was complete (TLC, $CH_2Cl_2$:MeOH, 9:1). The reaction was quenched by pouring into cold water (about 2 L) followed by acidification to reach a pH of 1. The mixture was extracted with ethyl ether, the combined organic extracts were washed with water and brine, dried ($MgSO_4$), and concentrated in vacuo. The crude product was purified by flash chromatography to furnish 41 g of the desired ballast acid (6) as a yellow oil.

Preparation of Ballast Acid Chloride (7)

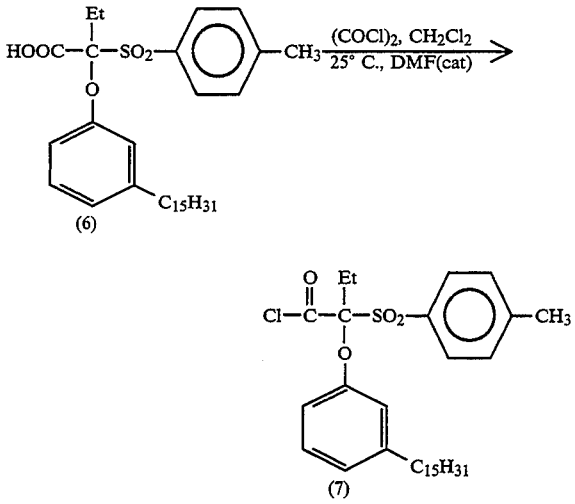

To a well stirred solution of the ballast acid (7.25 g, 13.3 mmol) in dichloromethane, maintained at 0° C., was added oxalyl chloride (1.97 g, 14 mmol) dropwise, followed by the addition of four drops of DMF to serve as the catalyst. The reaction mixture was stirred well and allowed to equilibrate to room temperature. The reaction was complete in 1 hour (TLC after methanolysis). The solvents were removed and the residue was repeatedly (three times) treated with 25 mL of dichloromethane, followed by removal under vacuo to furnish the ballast acid chloride (7) as a gold oil.

Preparation of a coupler of the present invention (M-1)

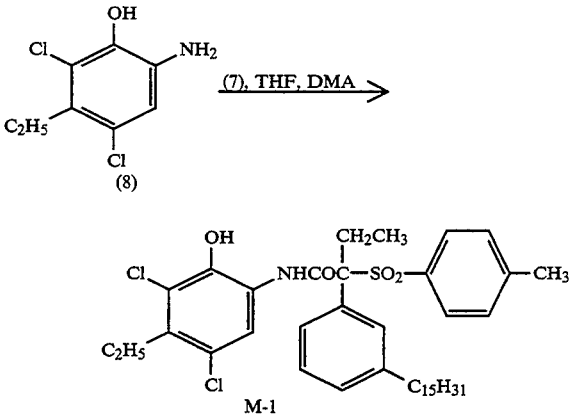

To a well stirred mixture of coupler carrier (8.5 g, 12 mmol) in THF (25 ml) and of N,N-dimethylaniline (18.2 mmol), at 0° C. was added the above acid chloride dissolved in THF dropwise through an addition funnel. Then the well stirred mixture was allowed to equilibrate to room temperature and stirred overnight. The reaction was complete (TLC, ligroin950:EtOAc, 10:1). The reaction was quenched by pouring into stirred ice water, acidified to pH 2, and the resulting oil was extracted with ether (three times). The combined organic extracts were washed with water and brine, dried ($MgSO_4$), and the solvents were distilled off under vacuo. The crude coupler (M-1) obtained as a reddish-brown oil was further purified by flash chromatography as a white crystalline solid (mp 83°–84° C., HPLC≧98% pure).

The couplers of this invention can be incorporated in silver halide emulsions and the emulsions can be coated on a support to form a photographic element. Alternatively, the couplers can be incorporated in photographic elements adjacent the silver halide emulsion where, during development, the coupler will be in reactive association with development products such as oxidized color developing agent.

The photographic elements can be either single color or multicolor elements. Multicolor elements contain dye image-forming units sensitive to each of the three primary regions of the spectrum. Each unit can be comprised of a single emulsion layer or of multiple emulsion layers sensitive to a given region of the spectrum. The layers of the element, including the layers of the image-forming units, can be arranged in various orders as known in the art.

A typical multicolor photographic element comprises a support bearing a cyan dye image-forming unit comprising at least one red-sensitive silver halide emulsion layer having associated therewith at least one cyan dye-forming coupler, a magenta image-forming unit comprising at least one green-sensitive silver halide emulsion layer having associated therewith at least one magenta dye-forming coupler and a yellow dye image-forming unit comprising at least one blue-sensitive silver halide emulsion layer having associated therewith at least one yellow dye-forming coupler. The element can contain additional layers, such as filter layers, inter-layers, overcoat layers, subbing layers, and the like.

In the following discussion of suitable materials for use in the elements of this invention, reference will be made to *Research Disclosure*, December 1978, Item 17643, published by Kenneth Mason Publications, Ltd., The Old Harbourmaster's, 8 North Street, Emsworth, Hampshire PO10 7DD, ENGLAND, and *Research Disclosure*, December 1989, Item 308119, the disclosures of which are incorporated herein by reference. This latter publication will be identified hereafter by the term "*Research Disclosure.*"

The silver halide emulsions employed in the elements of this invention can be composed of silver bromide, silver chloride, silver iodide, silver chlorobromide, silver chloroiodide, silver bromoiodide, silver chlorobromoiodide or mixtures thereof. The emulsions can include silver halide grains of any conventional shape or size. Specifically, the emulsions can include coarse, medium or fine silver halide grains. High aspect ratio tabular grain emulsions are specifically contemplated, such as those disclosed by Wilgus et al, U.S. Pat. No. 4,434,226; Daubendiek et al, U.S. Pat. No. 4,414,310; Wey, U.S. Pat. No. 4,399,215; Solberg et al, U.S. Pat. No. 4,433,048; Mignot, U.S. Pat. No. 4,386,156; Evans et al, U.S. Pat. No. 4,504,570; Maskasky, U.S. Pat. No. 4,400,463; Wey et al, U.S. Pat. No. 4,414,306; Maskasky, U.S. Pat. Nos. 4,435,501 and 4,643,966; and Daubendiek et al, U.S. Pat. Nos. 4,672,027 and 4,693,964. Also, specifically contemplated are those silver bromoiodide grains with a higher molar proportion of iodide in the core of the grain than in the periphery of the grain, such as those described in GB 1,027,146; JA 54/48,521; U.S. Pat. Nos. 4,379,837; 4,444,877; 4,665,012; 4,686,178; 4,565,778; 4,728,602; 4,668,614; 4,636,461; EP 264,954. The silver halide emulsions can be either monodisperse or polydisperse as precipitated. The grain size distribution of the emulsions can be controlled by silver halide grain separation techniques or by blending silver halide emulsions of differing grain sizes.

Sensitizing compounds, such as compounds of copper, thallium, lead, bismuth, cadmium and group VIII noble metals, can be present during precipitation of the silver halide emulsion.

The emulsions can be surface-sensitive emulsions, i.e., emulsions that form latent images primarily on the surfaces of the silver halide grains, or internal latent images predominantly in the interior of the silver halide grains. The emulsions can be negative-working emulsions, such as surface-sensitive emulsions or unfogged internal latent image-forming emulsions, or direct-positive emulsions of the unfogged, internal latent image-forming type, which are positive-working when development is conducted with uniform light exposure or in the presence of a nucleating agent.

The silver halide emulsions can be surface sensitized. Noble metal (e.g., gold), middle chalcogen (e.g., sulfur, selenium, or tellurium), and reduction sensitizers, employed individually or in combination, are specifically contemplated.

Typical chemical sensitizers are listed in *Research Disclosure*, Items 17643 and 308119, cited above, Section III.

The silver halide emulsions can be spectrally sensitized with dyes from a variety of classes, including the polymethine dye class, which includes the cyanines, merocyanines, complex cyanines and merocyanines (i.e., tri-, tetra-, and polynuclear cyanines and merocyanines), oxonols, hemioxonols, styryls, merostyryls, and streptocyanines. Illustrative spectral sensitizing dyes are disclosed in *Research Disclosure*, Items 17643 and 308119, cited above, Section IV.

Suitable vehicles for the emulsion layers and other layers of elements of this invention are described in *Research Disclosure* Items 17643 and 308119, Section IX and the publications cited therein.

In addition to the couplers described herein the elements of this invention can include additional couplers as described in *Research Disclosure* , Items 17643 and 308119, Section VII, and the publications cited therein. These additional couplers can be incorporated as described in the above *Research Disclosure* and the publications cited therein.

The photographic elements of this invention can contain brighteners (*Research Disclosure* Items 17643 and 308119 Section V), antifoggants and stabilizers (*Research Disclosure* Items 17643 and 308119 Section VI), antistain agents and image dye stabilizers (*Research Disclosure* Items 17643 and 308119 Section VII, paragraphs I and J), light absorbing and scattering materials (*Research Disclosure* Items 17643 and 308119 Section VIII), hardeners (*Research Disclosure* Items 17643 and 308119 Section X), coating aids (*Research Disclosure* Items 17643 and 308119 section XI), plasticizers and lubricants (*Research Disclosure* Items 17643 and 308119 Section XII), antistatic agents (*Research Disclosure* Items 17643 and 308119 Section XIII), matting agents (*Research Disclosure* Items 17643 and 308119 Section XVI) and development modifiers (*Research Disclosure* Items 17643 and 308119 Section XXI).

The photographic elements can be coated on a variety of supports as described in *Research Disclosure* Items 17643 and 308119 Section XVII and the references described therein.

Photographic elements can be exposed to actinic radiation, typically in the visible region of the spectrum, to form a latent image as described in *Research Disclosure* Items 17643 and 308119 Section XVIII and then processed to form a visible dye image as described in *Research Disclosure* Items 17643 and 308119 Section XIX. Processing to form a visible dye image includes the step of contacting the element with a color developing agent to reduce developable silver halide and oxidize the color developing agent. Oxidized color developing agent in turn reacts with the coupler to yield a dye.

Preferred color developing agents are p-phenylene diamines. Especially preferred are 4-amino-3-methyl-N, N-diethylaniline hydrochloride, 4-amino-3-methyl-N-ethyl-N-β-(methanesulfonamido)-ethylaniline sulfate hydrate, 4-amino-3-methyl-N-ethyl-N-β-hydroxyethylaniline sulfate, 4-amino-3-β-(methanesulfonamido)ethyl-N,N-diethylaniline hydrochloride and 4-amino-N-ethyl-N-(2-methoxy-ethyl)-m-toluidine di-p-toluene sulfonic acid.

With negative-working silver halide, the processing step described above provides a negative image. The described elements can be processed in the known C-41 color process as described in, for example, the British Journal of Photography Annual of 1982, pages 209–211 and 1988, pages 191–198 or in known processes for processing color photographic papers, such as the known RA-4 of Eastman Kodak Company. The described elements are optionally processed in the known color processes for processing color print papers, such as the processes described in the British Journal of Photography Annual of 1988, pages 198–199. To provide a positive (or reversal) image, the color development step can be preceded by development with a non-chromogenic developing agent to develop exposed silver halide, but not form dye, and then uniformly fogging the element to render unexposed silver halide developable. Alternatively, a direct positive emulsion can be employed to obtain a positive image.

Development is followed by the conventional steps of bleaching, fixing, or bleach-fixing, to remove silver or silver halide, washing, and drying.

The following examples further illustrate the invention.

Dispersions of the couplers were prepared in the following manner: The quantities of each component are found in Table I. In one vessel, the coupler, stabilizer (2,2',3,3'-tetrahydro-3,3,3',3'-tetramethyl-5,5',6,6,'-tetrapropoxy-1,1'-spirobi[1H-indene]), coupler solvent (tritolyl phosphate), and ethyl acetate were combined and warmed to dissolve. In a second vessel, gelatin, surfactant (Alkanol XC and Trademark of E. I. Dupont Co., U.S.A.) and water were combined and warmed to about 40° C. The two solutions were mixed together and passed three times through a Gaulin colloid mill. The ethyl acetate was removed by evaporation and the volume was readjusted with water. The comparative couplers are listed on pages 51–53.

Dispersions were prepared in two parts according to Table I. Part 1 was warmed to dissolve the coupler, and Part 2 was warmed to about 40° C. Parts 1 and 2 were then combined and emulsified by passing the mixture three times through a Gaulin colloid mill.

TABLE I

| Dispersion No. | Part 1 | Part 2 |
|---|---|---|
| D-1 | 1.500 grams M-1 + 6.153 grams Solution A | 12.02 grams Solution D + 19.08 grams water |
| D-2 | 1.255 grams CM-1 + 5.148 grams Solution A | 12.02 grams Solution D + 2.033 grams water |
| D-3 | 1.026 grams CM-2 + 4.209 grams Solution A | 12.02 grams Solution D + 21.50 grams water |
| D-4 | 1.411 grams M-2 + 7.237 grams Solution B | 12.02 grams Solution D + 18.08 grams water |
| D-5 | 1.019 grams CM-3 + 5.226 grams Solution B | 12.02 grams Solution D + 20.49 grams water |
| D-6 | 1.414 grams CM-4 + 7.252 grams Solution B | 12.02 grams Solution D + 18.06 grams water |
| D-7 | 1.759 grams C-1 + 6.276 grams Solution C | 12.02 grams Solution D + 18.70 grams water |
| D-8 | 1.216 grams CC-1 + 4.349 grams Solution C | 12.02 grams Solution D + 21.16 grams water |
| D-9 | 1.387 grams CC-2 + 4.949 grams Solution C | 12.02 grams Solution D + 20.39 grams water |

Solutions A, B, C, and D were prepared as follows and warmed as necessary to dissolve the solids:

| | |
|---|---|
| Solution A: | |
| Stabilizer ST-1 | 2.1 grams |
| Antioxidant A-1 | 0.5 grams |
| Solvent S-1 | 2.5 grams |
| Solvent S-4 | 15.0 grams |
| Solution B: | |
| Stabilizer ST-2 | 3.0 grams |
| Stabilizer ST-3 | 3.3 grams |
| Antioxidant A-2 | 1.7 grams |
| Solvent S-2 | 10.0 grams |
| Solvent S-3 | 5.0 grams |
| Solvent S-4 | 9.3 grams |
| Solution C: | |
| Antioxidant A-1 | 0.08 grams |
| Solvent S-1 | 5.5 grams |
| Solvent S-4 | 30.0 grams |
| Solution D: | |
| 24% Gelatin | 145.35 grams |
| 10% Alkanol XC © (E. I. Dupont Co.) | 34.95 grams |

The solvents, stabilizers and antioxidants found in Solutions A, B, and C are shown below:

Solvents:

| | |
|---|---|
| Dibutyl phthalate | S-1 |
| Tritolyl phosphate | S-2 |
| Tris(2-ethylhexyl)phosphate | S-3 |
| Ethyl acetate | S-4 |

Stabilizers:

ST-1

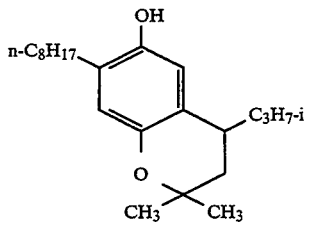

-continued

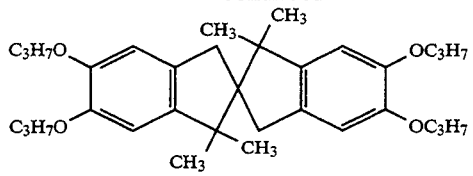

ST-2

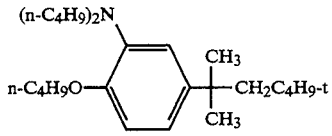

ST-3

Antioxidants:

2,5-(Bis(1,1,3,3-tetramethylbutyl)hydroquinone A-1

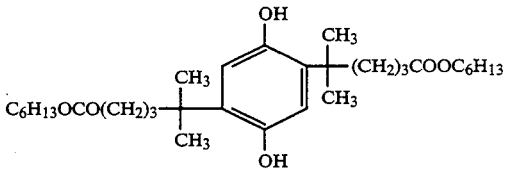

A-2

The photographic elements were prepared by coating the following layers in the order listed on a resin-coated paper support:

| | |
|---|---|
| 1st Layer | |
| Gelatin | 3.23 g/m$^2$ |
| 2nd Layer | |
| Gelatin | 1.61 g/m$^2$ |
| Coupler Dispersion (See Table II) | 4.3 × 10$^{-7}$ mole coupler/m$^2$ |
| Green-sensitized AgCl gelatin emulsion | 0.17 mg Ag/m$^2$ |
| 3rd Layer | |
| Gelatin | 1.33 g/m$^2$ |
| 2-(2H-benzotriazol-2-yl)-4,6-bis-(1,1-dimethylpropyl)phenol | 0.73 g/m$^2$ |
| Tinuvin 326 (U.V. absorber and trademark of Ciba-Grigg Corp., U.S.A) | 0.13 g/m$^2$ |
| 4th Layer | |
| Gelatin | 1.40 g/m$^2$ |
| Bis(vinylsulfonylmethyl)ether | 0.14 g/m$^2$ |

TABLE II

| Example No. | Dispersion | Millimoles coupler/meter$^2$ | Emulsion sensitization | mg Ag/meter$^2$ |
|---|---|---|---|---|
| 1 | D-1 | 5.6 | Green | 0.29 |
| 2 | D-2 | 5.6 | Green | 0.29 |
| 3 | D-3 | 5.6 | Green | 0.29 |
| 4 | D-4 | 4.3 | Green | 0.17 |
| 5 | D-5 | 4.3 | Green | 0.17 |
| 6 | D-6 | 4.3 | Green | 0.17 |
| 7 | D-7 | 8.3 | Red | 0.20 |
| 8 | D-8 | 8.3 | Red | 0.20 |
| 9 | D-9 | 8.3 | Red | 0.20 |

The photographic elements were given stepwise exposures to green light and processed as follows at 35° C.:

| | |
|---|---|
| Developer | 45 seconds |
| Bleach-Fix | 45 seconds |
| Wash (running water) | 1 minute, 30 seconds |

The developer and bleach-fix were of the following compositions:

| | |
|---|---|
| Developer | |
| Water | 700.00 mL |
| Triethanolamine | 12.41 g |
| Blankophor REU TM (Mobay Corp.) | 2.30 g |
| Lithium polystyrene sulfonate (30%) | 0.30 g |
| N,N-Diethylhydroxylamine (85%) | 5.40 g |
| Lithium sulfate | 2.70 g |
| N-{2-[(4-amino-3-methylphenyl)ethylamino] ethyl}-methanesulfonamide, sesquisulfate | 5.00 g |
| 1-Hydroxyethyl-1,1-diphosphonic acid (60%) | 0.81 g |
| Potassium carbonate, anhydrous | 21.16 g |
| Potassium chloride | 1.60 g |
| Potassium bromide | 7.00 mg |
| Water to make | 1.00 L |
| pH @ 26.7° C. adjusted to 10.4 ± 0.05 | |
| Bleach-Fix | |
| Water | 700.00 mL |
| Solution of ammonium thiosulfate (56.4%) + Ammonium sulfite (4%) | 127.40 g |
| Acetic acid (glacial) | 10.20 g |
| Solution of ammonium ferric ethylenediaminetetraacetate (44%) + ethylenediaminetetraacetic acid (3.5%) | 110.40 g |
| Water to make | 1.00 L |
| pH @ 26.7° C. adjusted to 6.7 | |

Magenta or cyan dyes were formed upon processing. The following photographic characteristics were determined: D-max (the maximum density), Speed (the relative Log Exposure (logE) required to yield a density of 1.0), and Contrast (the slope of a line connecting the two points on the Density vs logE curve at which logE is 0.3 less and 0.3 greater, respectively, than the logE which yields a density of 1.0). These values for each example are tabulated in Table III.

TABLE III

| Example No. | Coupler | D-max | Contrast | Speed |
|---|---|---|---|---|
| 1 | M-1 | 2.58 | 2.84 | 146 |
| 2 | CM-1 | 2.43 | 2.62 | 145 |
| 3 | CM-2 | 2.54 | 3.26 | 154 |
| 4 | M-2 | 2.52 | 2.61 | 149 |
| 5 | CM-3 | 2.43 | 2.56 | 147 |
| 6 | CM-4 | 2.52 | 2.53 | 142 |
| 7 | C-1 | 2.36 | 2.74 | 150 |
| 8 | CC-1 | 2.38 | 2.78 | 152 |
| 9 | CC-2 | 2.31 | 2.76 | 152 |

The dye hues are characterized by the wavelength of maximum absorption (lambdamax) and bandwidth in nanometers at 50% peak height, both measured in nanometers. These values are found in Table IV.

TABLE IV

| Example No. | Coupler | Lambda-max | Bandwidth |
|---|---|---|---|
| 1 | M-1 | 542 | 102 |
| 2 | CM-1 | 540 | 106 |
| 3 | CM-2 | 543 | 110 |
| 4 | M-2 | 538 | 94 |
| 5 | CM-3 | 537 | 97 |
| 6 | CM-4 | 534 | 96 |
| 7 | C-1 | 673 | 180 |
| 8 | CC-1 | 662 | 172 |
| 9 | CC-2 | 658 | 190 |

Dye stability was measured by illuminating the processed strips to simulated daylight at an intensity of 50 kilolux and determining the time in weeks required for 30% density loss from an initial density of 1.00. The results are shown in Table V.

TABLE V

| Example No. | Coupler | Dye Stability |
|---|---|---|
| 1 | M-1 | 1.02 |
| 2 | CM-1 | 1.63 |
| 3 | CM-2 | 0.80 |
| 4 | M-2 | 2.79 |
| 5 | CM-3 | 2.51 |
| 6 | CM-4 | 2.27 |
| 7 | C-1 | 3.10 |
| 8 | CC-1 | 5.10 |
| 9 | CC-2 | 7.75 |

Comparisons should be made within groups separated by horizontal lines in the tables above, since these are structurally related compounds which were tested in the same manner. The couplers of our invention had excellent coupling activity. Their dyes intended to be slightly bathochromic to the comparative dyes and had narrower bandwidths; this is often especially advantageous in the case of magenta dyes. The magenta dyes had excellent stability to light, especially the 2-equivalent coupler M-2.

Comparative Coupler 1

CC-1

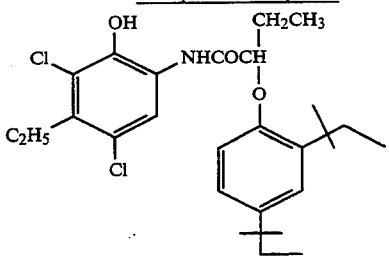

Comparative Coupler 2

CC-2

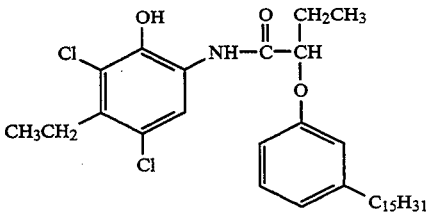

Comparative Coupler 3

CM-1

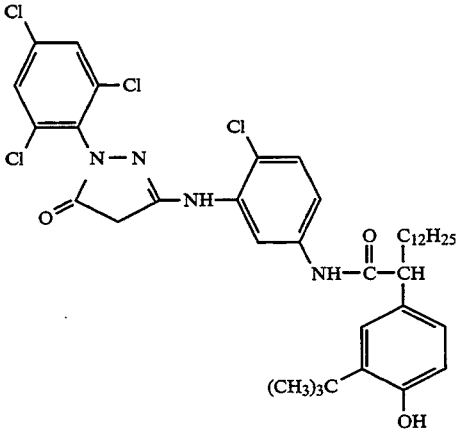

Comparative Coupler 4

-continued

CM-2

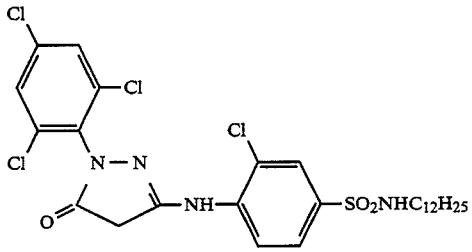

Comparative Coupler 5

CM-3

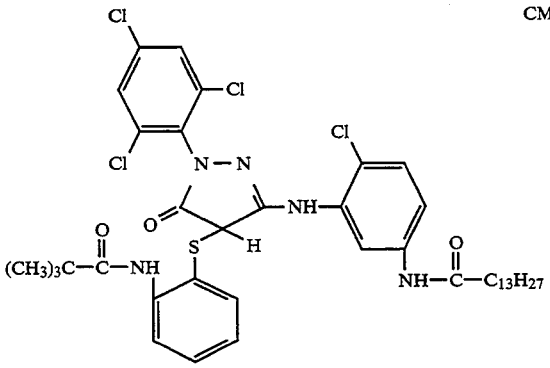

Comparative Coupler 6

CM-4

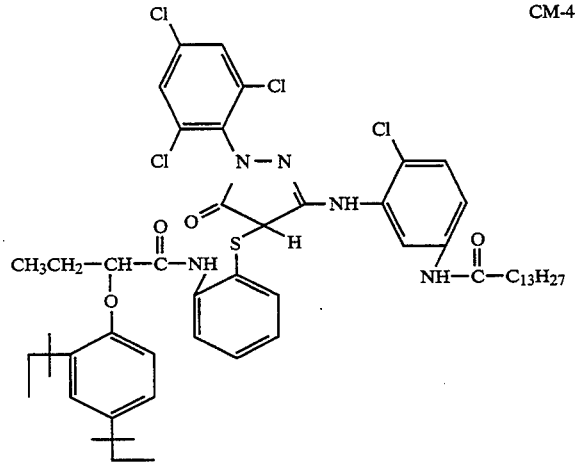

The invention has been described in detail with particular reference to preferred embodiments thereof, but it will be understood that variations and modifications can be effected within the spirit and scope of the invention.

What is claimed is:

1. A photographic element comprising a support bearing at least one photographic silver halide emulsion layer and a dye-forming coupler, wherein the dye-forming coupler is represented by formula (I):

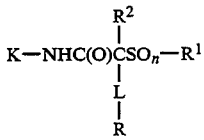

(I)

wherein:

n is 1 or 2;

$R^2$ is hydrogen or a substituent;

R and $R^1$, which may the same or different, are a substituent;

L is selected from the group consisting of O, S, Se, Te, $Si(R^5)_2$, $NR^5$, $PR^5$, $P(O)(R^5)_2$ and $NR^5SO_2$, wherein $R^5$ represents hydrogen, alkyl or aryl; and K is a coupler moiety selected from the group consisting of pyrazolone, phenol, and naphthol.

2. A photographic element as in claim 1, wherein the coupler is represented by the formula (II):

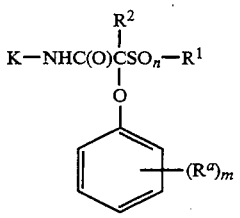

(II)

wherein:

n, $R^2$, $R^1$ and K are as defined in claim 1;

m is from 0 to 5; and each $R^a$ is independently a substituent.

3. A photographic element as in claim 2, wherein at least one $R^a$ is alkyl.

4. A photographic element as in claim 3, wherein n is 2, $R^1$ is aralkyl, and $R^2$ is alkyl.

5. A photographic element as in claim 1, wherein n is2.

6. A photographic element as in claim 1, wherein L is O.

7. A photographic element as in claim 1, wherein K is selected from the group consisting of:

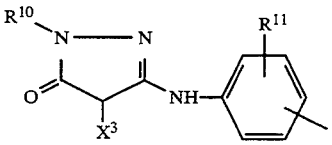

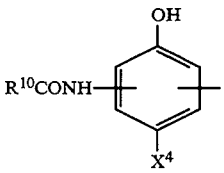

-continued

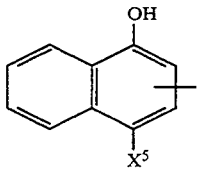

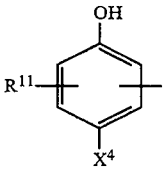

and

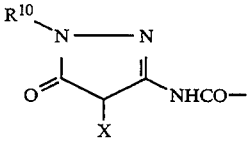

wherein:

each of X, $X^3$, $X^4$ and $X^5$ is H or a coupling-off group;

$R^{10}$ represents a ballast group or a substituted or unsubstituted alkyl or aryl group; and $R^{11}$ represents one or more halogen atoms, alkyl having 1 to 4 carbon atoms or alkoxy having 1 to 4 carbon atoms.

8. A photographic element as in claim 7, wherein L is O and R is an aryl or substituted aryl group.

9. A process of forming a dye image in a photographic element as described in claim 1 after said element has been exposed to light, said process comprising developing the photographic element with a color silver halide developing agent.

10. A process as in claim 9, wherein the photographic element contains a coupler represented by the formula (II):

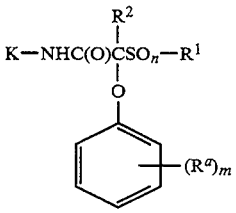

(II)

wherein:

n is 1 or 2;

$R^2$ is hydrogen or a substituent;

$R^1$ is a substituent;

K is a coupler moiety selected from the group consisting of pyrazolone, phenol and naphthol, M is from 0 to 5; and each $R^a$ is independently a substituent.

* * * * *